US011279128B2

(12) United States Patent
Tabeta

(10) Patent No.: US 11,279,128 B2
(45) Date of Patent: Mar. 22, 2022

(54) IMAGE FORMING APPARATUS, METHOD OF CONTROLLING IMAGE FORMING APPARATUS AND STORAGE MEDIUM

(71) Applicant: CANON KABUSHIKI KAISHA, Tokyo (JP)

(72) Inventor: Hideya Tabeta, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/928,384

(22) Filed: Jul. 14, 2020

(65) Prior Publication Data

US 2021/0039385 A1 Feb. 11, 2021

(30) Foreign Application Priority Data

Aug. 8, 2019 (JP) ..... JP2019-146237

(51) Int. Cl.
*B41J 2/045* (2006.01)

(52) U.S. Cl.
CPC ..... *B41J 2/04586* (2013.01); *B41J 2/0451* (2013.01); *B41J 2/04555* (2013.01); *B41J 2/0457* (2013.01)

(58) Field of Classification Search
CPC .. B41J 2/04586; B41J 2/0451; B41J 2/04555; B41J 2/0457
See application file for complete search history.

(56) References Cited

U.S. PATENT DOCUMENTS

| | | | | |
|---|---|---|---|---|
| 7,539,886 | B2 * | 5/2009 | Suga | G06F 1/3284 713/324 |
| 9,653,994 | B2 | 5/2017 | Taguchi | |
| 9,883,067 | B2 * | 1/2018 | Kozuka | H04N 1/00904 |
| 10,668,718 | B2 * | 6/2020 | Kusumoto | B41J 2/04548 |
| 2012/0050354 | A1 | 3/2012 | Taguchi | |

FOREIGN PATENT DOCUMENTS

| | | |
|---|---|---|
| JP | 2012-50202 | 3/2012 |

* cited by examiner

*Primary Examiner* — Thinh H Nguyen
(74) *Attorney, Agent, or Firm* — Venable LLP

(57) ABSTRACT

An image forming apparatus includes a print head, a main control unit, a head control unit, and a head unit power supply to generate a voltage to be supplied to the head control unit. The main control unit checks whether the main control unit is normally started up. The head control unit includes an operation checker to check whether the head control unit normally operates if the main control unit is normally started up and the head control unit is supplied with a check voltage, a head power supply generator to generate a voltage to be supplied to the print head if the head control unit normally operates, and a status detector to detect a status of the print head based on the voltage supplied to the print head, and control the voltage to be supplied to the head control unit depending on the status detected by the status detector.

20 Claims, 10 Drawing Sheets

| FIG.4A | |
|---|---|
| FIG.4B | |

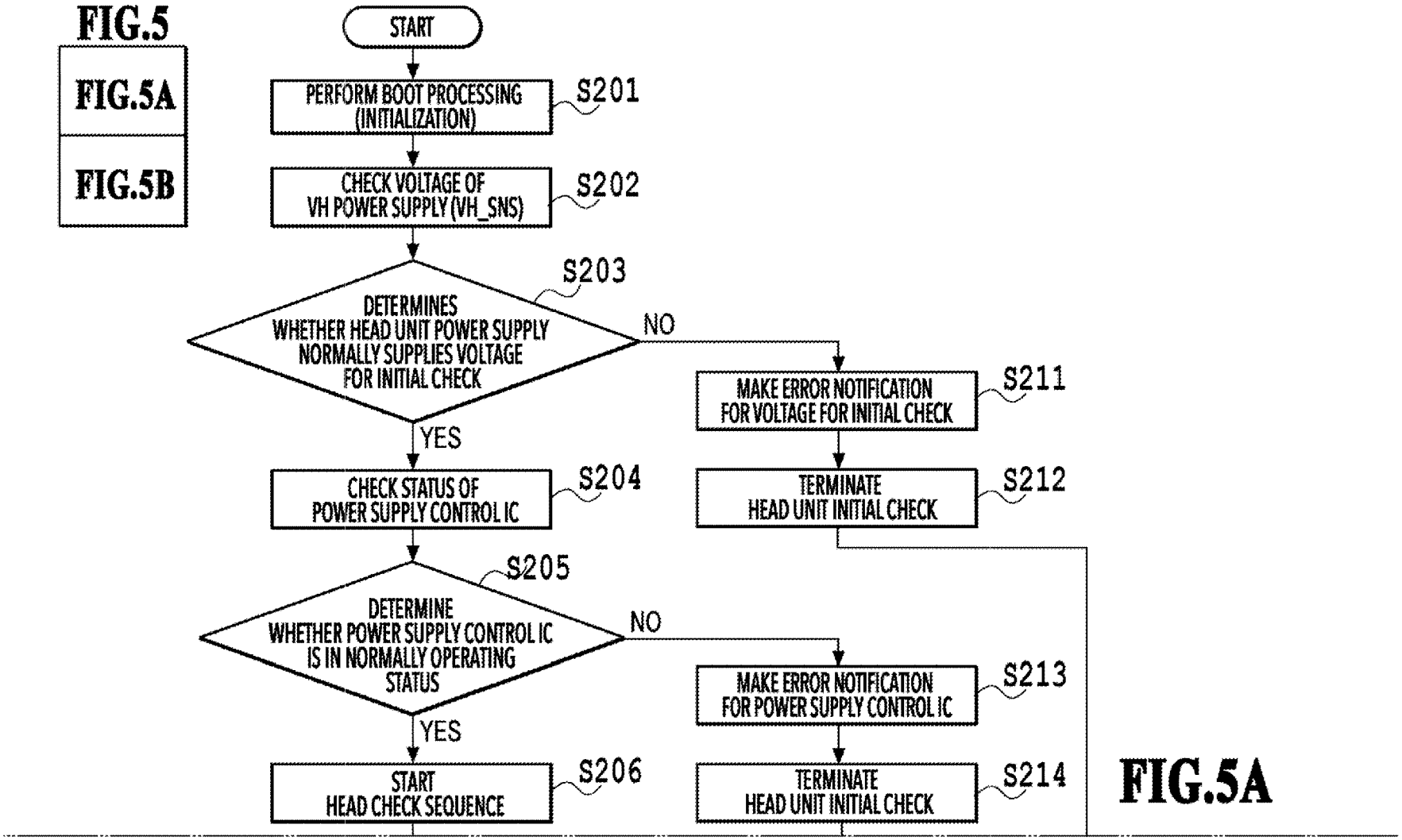
START
S201
PERFORM BOOT PROCESSING (INITIALIZATION)
S202
CHECK VOLTAGE OF VH POWER SUPPLY (VH_SNS)
S203
DETERMINES WHETHER HEAD UNIT POWER SUPPLY NORMALLY SUPPLIES VOLTAGE FOR INITIAL CHECK
NO
YES
S211
MAKE ERROR NOTIFICATION FOR VOLTAGE FOR INITIAL CHECK
S212
TERMINATE HEAD UNIT INITIAL CHECK
S204
CHECK STATUS OF POWER SUPPLY CONTROL IC
S205
DETERMINE WHETHER POWER SUPPLY CONTROL IC IS IN NORMALLY OPERATING STATUS
NO
YES
S213
MAKE ERROR NOTIFICATION FOR POWER SUPPLY CONTROL IC
S214
TERMINATE HEAD UNIT INITIAL CHECK
S206
START HEAD CHECK SEQUENCE
FIG.5
FIG.5A
FIG.5B
FIG.5A FIG.7
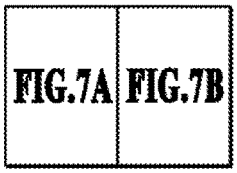
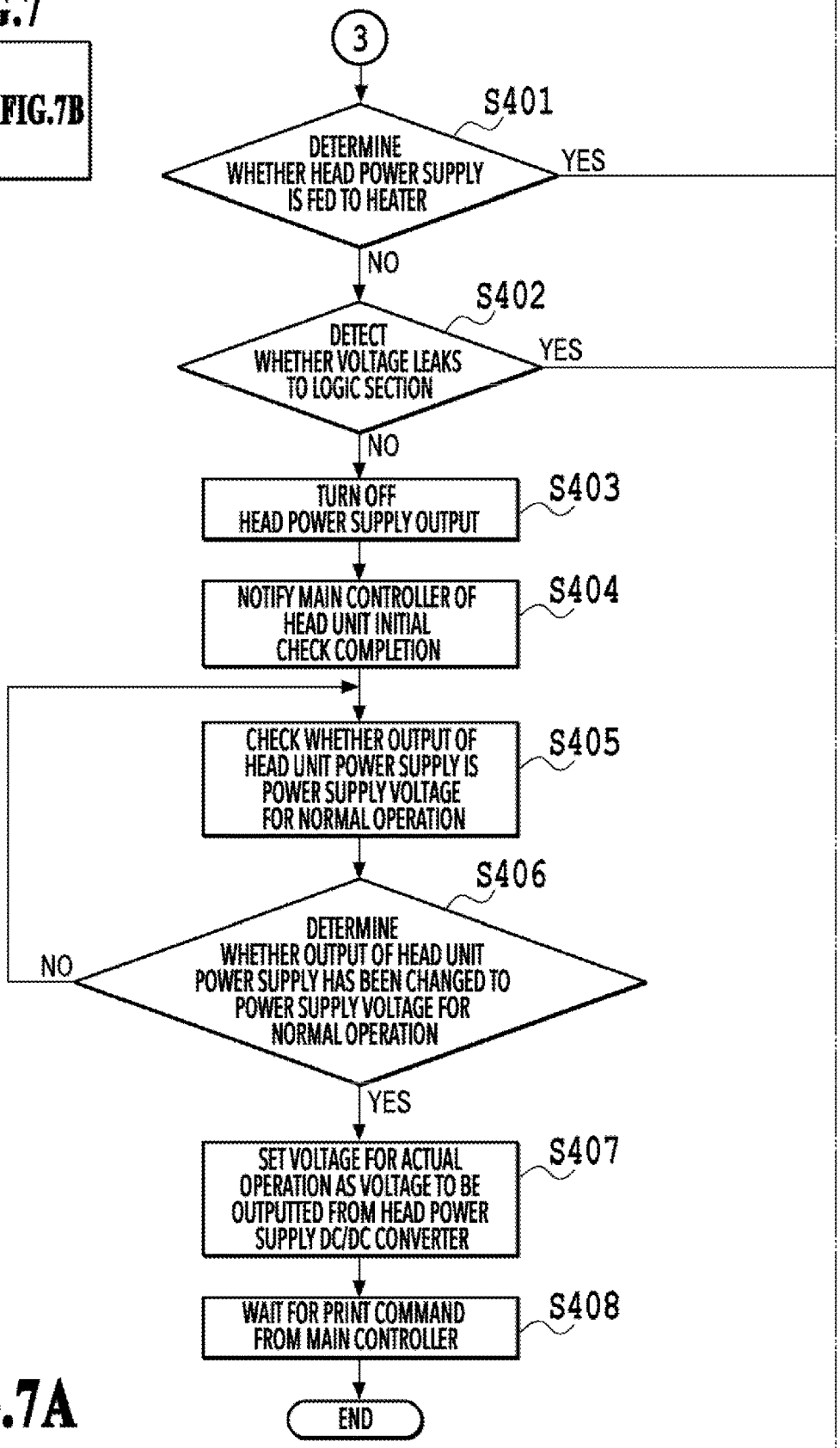
FIG.7A

IMAGE FORMING APPARATUS, METHOD OF CONTROLLING IMAGE FORMING APPARATUS AND STORAGE MEDIUM

BACKGROUND OF THE INVENTION

Field of the Invention

The present invention relates to an image forming apparatus and a method and program of controlling an image forming apparatus.

Description of the Related Art

Heretofore, as for image forming apparatuses, there has been known a technique of detecting a breakdown by checking electric conditions in an image forming apparatus. Japanese Patent Laid-open No. 2012-050202 discloses a technique of checking whether a breakdown occurs in an image forming apparatus in the process of starting up a power supply circuit and a power supply device for supplying a voltage to a printing head (for example, a DC/DC converter, a pre-CHG circuit, or the like).

SUMMARY OF THE INVENTION

In recent years, the importance of the technique of detecting an apparatus status has been increasing and there has been a need for safer detection technique.

The present invention has an object to provide a safer detection technique.

The present invention provides an image forming apparatus including a print head, a first control unit configured to control the image forming apparatus; a second control unit configured to control the print head; and a first voltage generator circuit configured to generate a voltage to be supplied to the second control unit under control of the first control unit. The first control unit includes a startup check unit configured to check whether the first control unit is normally started up. The second control unit includes an operation checker configured to check whether the second control unit normally operates in a case where the startup check unit confirms that the first control unit is normally started up and the second control unit is supplied with a check voltage that is lower than a voltage for normal operation, a second voltage generator circuit configured to generate a voltage to be supplied to the print head from the check voltage in a case where it is confirmed that the second control unit normally operates, and a status detector configured to detect a status of the print head based on the voltage supplied to the print head. The first control unit controls the voltage to be supplied to the second control unit based on the status detected by the status detector.

Further features of the present invention will become apparent from the following description of exemplary embodiments with reference to the attached drawings.

BRIEF DESCRIPTION OF THE DRAWINGS

FIG. 5A is a flowchart presenting a processing procedure executed by a control unit of the image forming apparatus;

FIG. 7A is the flowchart presenting the processing procedure executed by the control unit of the image forming apparatus.

DESCRIPTION OF THE EMBODIMENTS

Figure 1:
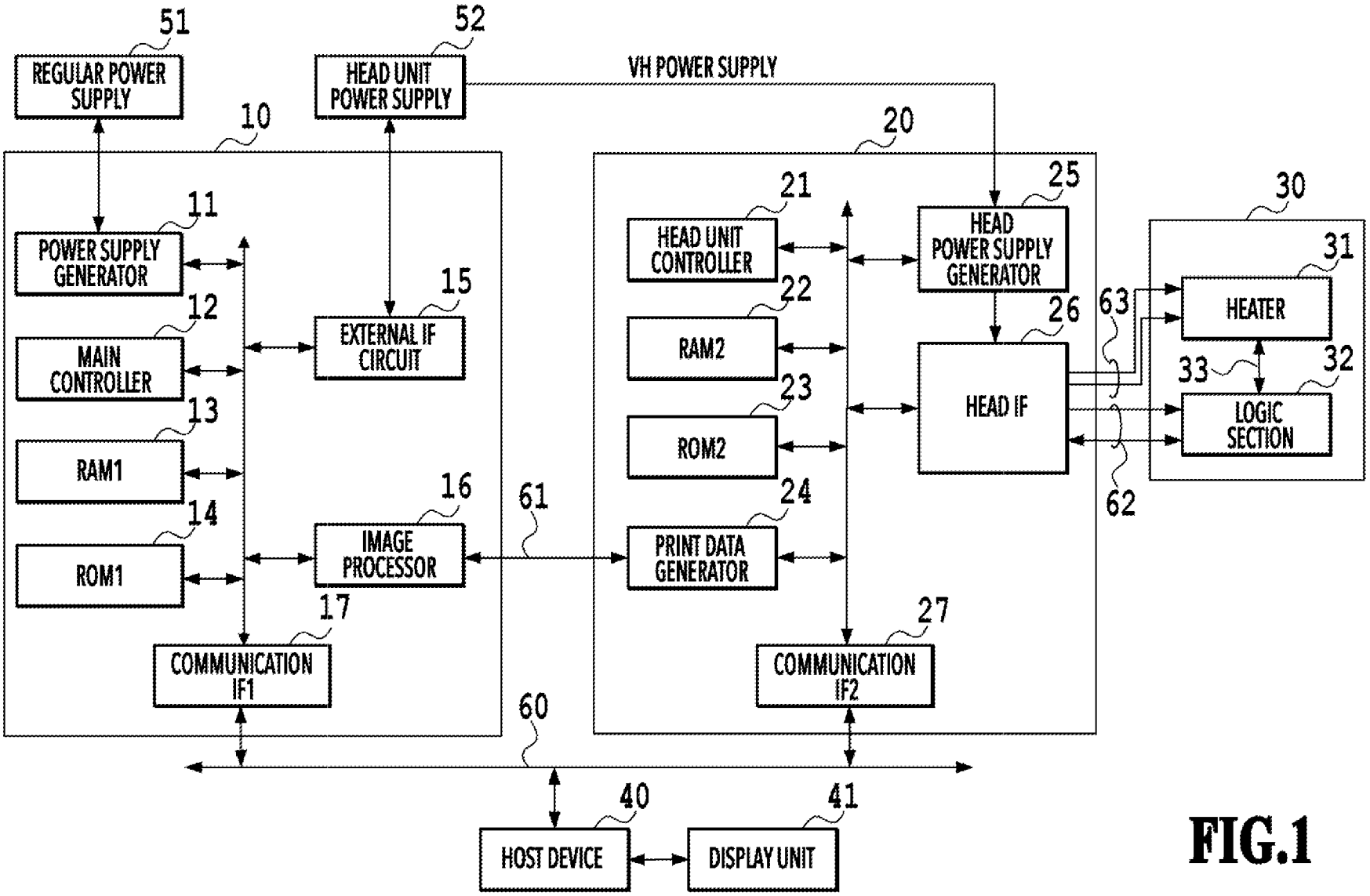
FIG. 1 is a block diagram illustrating a configuration of an image forming apparatus.

Hereinafter, with reference to the attached drawings, the present invention is explained in detail in accordance with preferred embodiments. Configurations shown in the following embodiments are merely exemplary and the present invention is not limited to the configurations shown schematically.

In addition, as a supplement, the same configurations are described with the same reference numerals.

FIG. 1 is a block diagram illustrating a configuration of an image forming apparatus according to the present embodiment. This block diagram illustrates a control configuration in the image forming apparatus. The image forming apparatus includes a main control unit 10, a head control unit 20, a head print unit 30, a host device 40, a display unit 41, a regular power supply 51, and a head unit power supply 52. In addition, the host device 40 and the main control unit 10 are coupled to each other and the host device 40 and the head control unit 20 are coupled to each other via a network 60 through which they mutually transmit and receive control data.

The main control unit 10 mainly controls entire printing operations. As illustrated in FIG. 1, the main control unit 10 includes a power supply generator 11, a main controller 12, a RAM1 13, a ROM1 14, an external IF circuit 15, an image processor 16, and a communication IF1 17. The power supply generator 11 is fed with a logic power supply (+12 V) from the regular power supply 51. The power supply generator 11 generates a voltage (for example, +5V/+3.3 V/+2.5 V/+1.0 V and the like) required in each of blocks in the main control unit 10 by using an ON/OFF switchable DC/DC converter, a regulator, and the like, and supplies the voltage to the corresponding block. Here, a power supply for the main controller 12 and a power supply for peripheral blocks are provided separately and power is supplied to the peripheral blocks under the control of the main controller 12.

The main controller 12 includes a CPU, a LAN controller, a serial input/output (SIO) bus, an inter-integrated circuit (I2C) bus, and a port. The main controller 12 controls the entire image forming apparatus in accordance with a program and various parameters stored in the ROM1 14 by using the RAM1 13 as a work area.

For example, when a print process is ordered (executed) by an operation on a touch panel of the display unit 41, the host device 40 outputs a print job to the main control unit 10 via the network 60. In response to input of the print job from the host device 40 via the communication IF1 17, the main controller 12 controls the image processor 16 so that the image processor 16 performs predetermined image processing on the received image data. Then, the main controller 12 transmits the image data after the image processing by the image processor 16 to a print data generator 24 of the head control unit 20 by using a high-speed serial communication data IF 61.

The image processor 16 is composed of, for example, an application specific integrated circuit (ASIC), a field programmable gate array (FPGA), or the like. The image processor 16 divides the image data after the image processing by the host device 40 into data sets for respective colors for printing in the head print unit 30, and transmits (transfers) the data set for each color to the corresponding head control unit 20. Note that only one head control unit 20 is illustrated in the present embodiment for convenience of explanation, but in fact multiple head control units 20 are provided for the respective colors for use. In addition, as a data transfer method, the high-speed serial communication data IF 61 may use any of methods including, but not limited to, a universal serial bus (USB), PCI express, and the like, for example.

The main controller 12 checks the status of the power supply generator 11, the internal state of the RAM1 13, and the status of the image processor 16. When the main controller 12 confirms that the main control unit 10 is normally started up, the main controller 12 subsequently causes the head unit power supply 52 to start to output a power supply by controlling a circuit inside the external IF circuit 15 in order to start up the head control unit 20. The head unit power supply 52 is an output-variable power supply (voltage generator circuit), which receives an analog signal (0 V to 5 V) from the external IF circuit 15 and linearly changes an output voltage up to 0 V to 32 V. Such a linear change (gradual change) of the voltage intends to avoid application of a high voltage and prevent a breakdown in the apparatus. The specifications in the present embodiment are set such that +5.5 V is supplied at the time of startup, but the voltage value is not particularly limited as long as the voltage can be confirmed to be safe.

The head control unit 20 performs printing control based on the received image data. The head control unit 20 includes a head unit controller 21, a RAM2 22, a ROM2 23, the print data generator 24, a head power supply generator 25, and a head IF 26. The head unit controller 21 prints the image data by controlling the entire head control unit 20 and the head print unit 30 in accordance with a program and various parameters stored in the ROM2 23 while using the RAM2 22 as a work area.

The print data generator 24 converts INDEX data transmitted from the image processor 16 into Bitmap data printable by the head. The head power supply generator 25 receives power for initial check and power for normal operation outputted from the head unit power supply 52, and supplies the power to each of blocks (for example, a logic control circuit and the like) and the head print unit 30.

The head IF 26 includes a head current detector that detects a head current to be supplied to the head print unit 30. The head IF 26 controls input and output of head logic control signals 62 in order that a logic section (logic circuit) 32 may generate a timing signal 33 to be used to eject ink at a predetermined timing in the head print unit 30. In addition, the head IF 26 controls provision of a head heater power supply 63 to a heater 31. The processing in the head IF 26 is described later by using FIG. 3.

The head print unit 30 includes the heater 31 that causes ink to be ejected by heating the ink and the logic section 32 that controls the timing of the ink ejection by the heater 31. In the head print unit 30, the logic section 32 outputs the timing signal 33 to the heater 31 in order that the head print unit 30 may eject ink at a predetermined timing. The specifications concerning the timing signal 33 are of a publicly known technique, and therefore the explanation thereof is omitted herein.

The display unit 41 is coupled to the host device 40 and displays conditions in the image forming apparatus. In addition, the display unit 41 is capable of receiving various commands (operations) for image processing by way of the touch panel or the like. Moreover, at the occurrence of a failure, the display unit 41 displays the name and the location of a portion having the failure, as described later.

Figure 2:
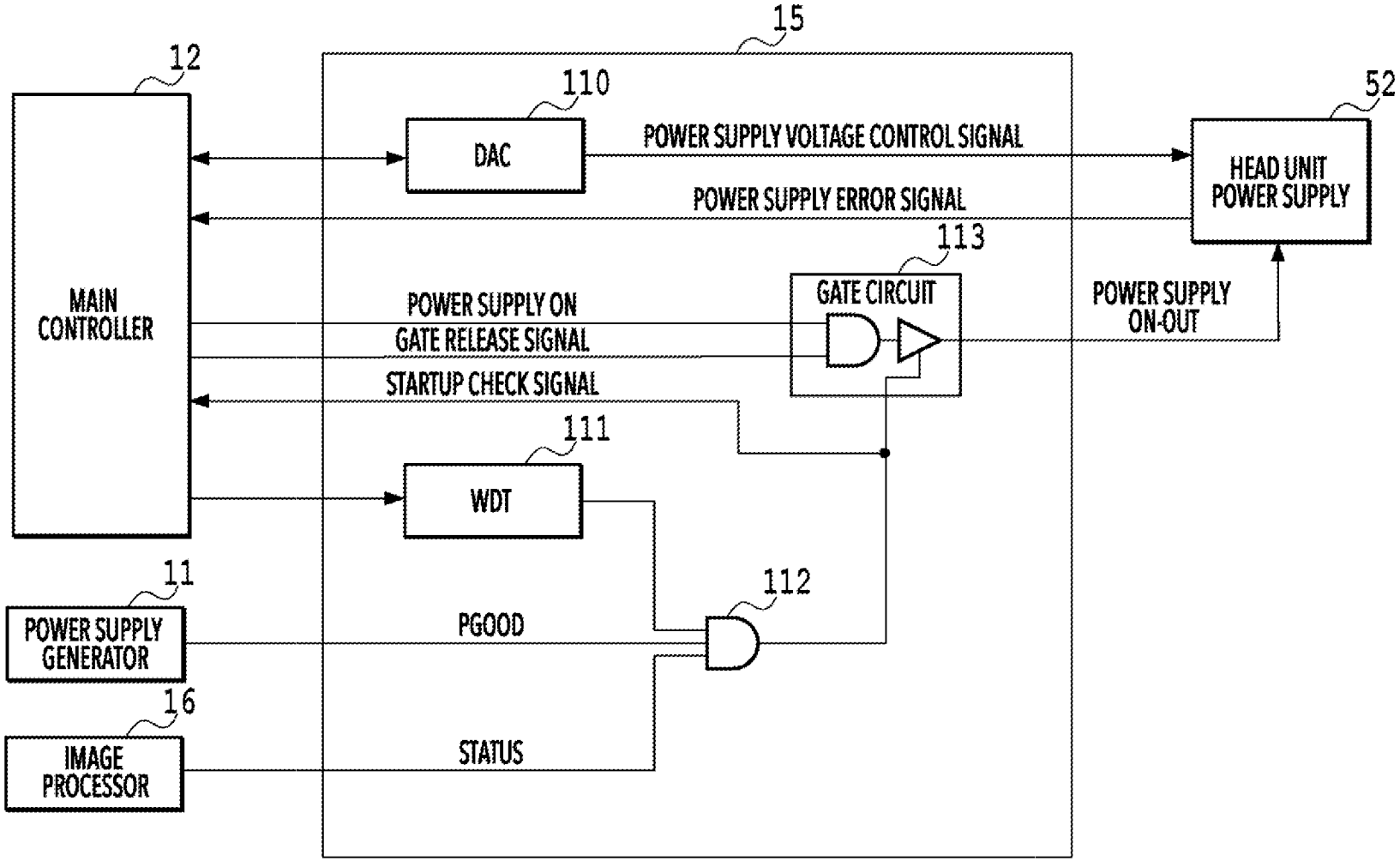
FIG. 2 is a block diagram illustrating a configuration of an external IF circuit.

Next, a configuration of the external IF circuit 15 is described using FIG. 2. FIG. 2 is a block diagram illustrating the configuration of the external IF circuit 15. As illustrated in FIG. 2, the external IF circuit 15 includes a digital-to-analog converter (DAC) 110, a watchdog timer (WDT) 111, an AND circuit 112, and a GATE circuit 113.

The DAC 110 changes a power supply voltage for the head unit power supply 52 under the control of the main controller 12 (for example, by way of the I2C or SIO bus or the like). In the present embodiment, using +5 V, the DAC 110 changes the output (power supply voltage) between 0 V and 5 V.

After the main controller 12 is started up, the main controller 12 accesses the WDT 111 to clear the timer at predetermined timings (for example, every 5 ms, every 10 ms, or the like). Meanwhile, when the WDT 111 is not accessed for a certain period, a counter is not cleared and the WDT 111 reverses the output upon lapse of a set period. In the present embodiment, the initial value of the WDT 111 is 'H' and the WDT 111 outputs 'L' in a case where an anomaly occurs.

The AND circuit 112 is a circuit for operation check, which calculates the logical product of the signal from the WDT 111, a power good (PGOOD) signal from the power supply generator 11, and a Status signal from the image processor 16, and outputs the calculation result (hereinafter, referred to as a startup check signal) to the main controller 12. Then, if the calculation result is 'H' (in other words, if all the signals are 'H'), the main controller 12 determines that the main control unit 10 is normally started up and starts processing of causing the head unit power supply 52 to output a voltage for initial check.

In order for the head unit power supply 52 to output the voltage for initial check, the main controller 12 performs port control when detecting that the aforementioned startup check signal outputted to the main controller 12 is 'H'. Specifically, the main controller 12 first outputs a GATE release signal to the GATE circuit 113 and then outputs a power supply ON signal to the GATE circuit 113. Under the port control of the main controller 12, the GATE circuit 113 outputs a power supply ON-OUT signal so that the head unit power supply 52 is enabled to output power. After that, the main controller 12 writes output data to the DAC 110 by using the I2C bus mounted on the main controller 12.

The DAC 110 has a resolution of 8 bits using +5 V, and performs output control of about 20 mV by 1 bit. The head unit power supply 52 outputs a voltage based on the voltage outputted from the DAC 110. The head unit power supply 52 changes the output voltage linearly with respect to the voltage outputted from the DAC 110. Here, as the head unit power supply, a usual one may be used, and for example, a power supply in HWS series manufactured by TDK-Lambda Corporation or the like may be used.

Figure 3:
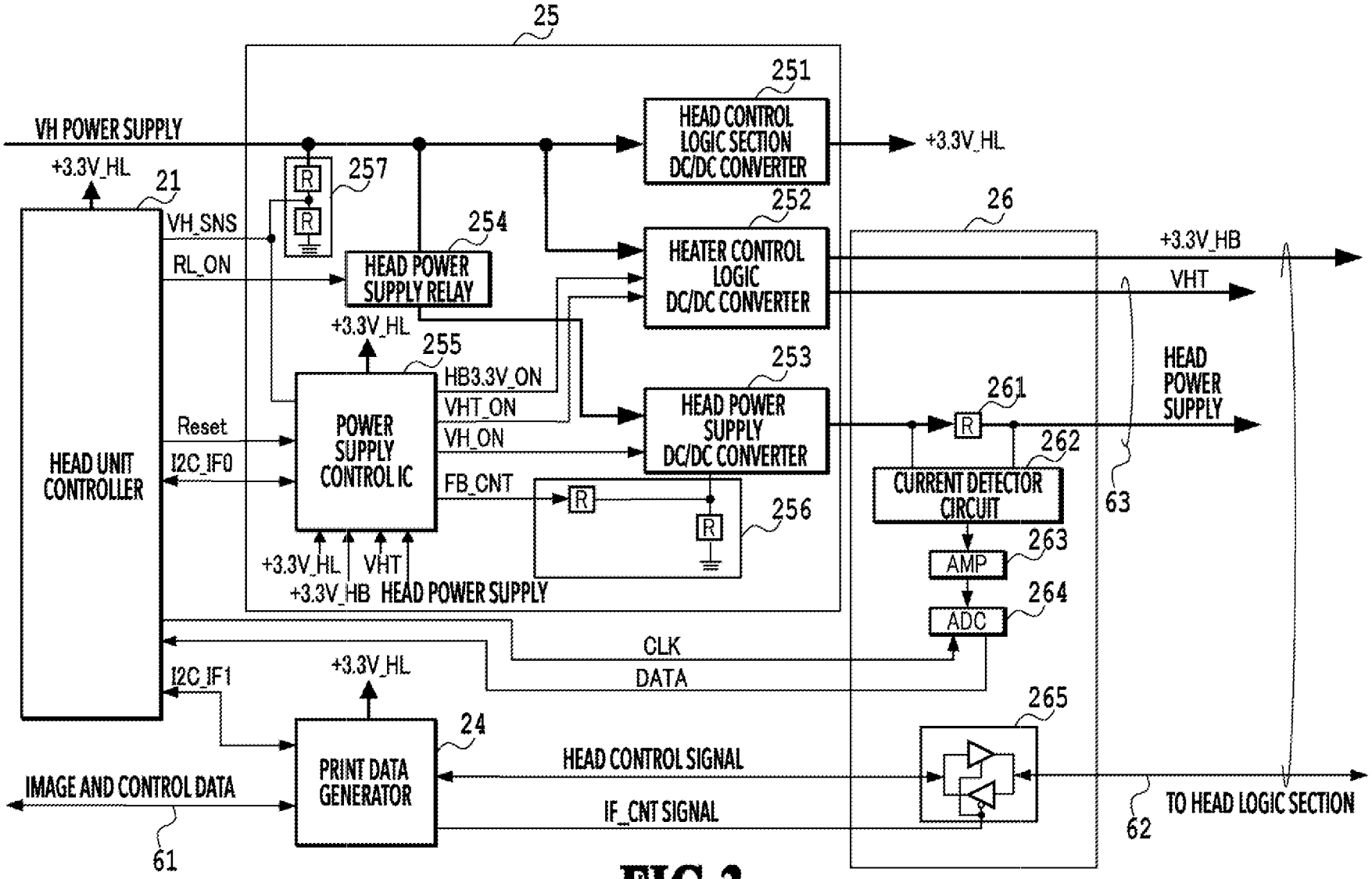
FIG. 3 is a block diagram illustrating configurations of a head power supply generator and a head IF.

Next, the configurations of the head power supply generator 25 and the head IF 26 are described using FIG. 3. FIG. 3 is a block diagram illustrating the configurations of the head power supply generator 25 and the head IF 26. As illustrated in FIG. 3, the head power supply generator 25 includes a head control logic section DC/DC converter 251, a heater control logic DC/DC converter 252, a head power supply DC/DC converter 253, a head power supply relay 254, a power supply control IC 255, and a feedback (FB) resistor 256.

The head control logic section DC/DC converter 251 generates logic power supplies for controlling the entire head control unit 20 from a VH power supply at a VH voltage of 0 V to 32 V outputted from the head unit power supply 52. Specifically, the head control logic section DC/DC converter 251 generates +3.3 V_HL, +1.0 V, and +2.5 V power supplies for operating the head unit controller 21.

The heater control logic DC/DC converter 252 generates, from the VH power supply, a power supply (+3.3 V_HB) to be fed to the logic section 32 of the head print unit 30 and a power supply (VHT) 63 for controlling the heater 31.

The head power supply DC/DC converter 253 generates a head heater power supply 63 from the VH power supply and feeds the head power supply 63 to the heater 31 of the head print unit 30. Here, the VH power supply to be fed to the head power supply DC/DC converter 253 is switchable between ON and OFF under control of the head unit controller 21. Then, each of the DC/DC converters used in this block is composed of a known FET, inductor, diode, and capacitor, adjusts the voltage according to features of the head print unit 30 under control of the power supply control IC 255, and outputs the adjusted voltage. Here, FET is an abbreviation for a field effect transistor.

The power supply control IC 255 is a power system manager (PSM). The power supply control IC 255 is equipped with multiple DACs and analog-to-digital converters (ADCs). As illustrated in FIG. 3, the power supply control IC 255 adjusts and monitors the voltage rising timing and the voltage of each of the power supplies including +3.3 V_HL, the head power supply, VHT, and +3.3 V_HB outputted from the DC/DC converters. In addition, the power supply control IC 255 manages faults, generates fault logs, and automatically stores the logs in an internal EEPROM.

Here, as the power supply control IC 255, used is an IC capable of power supply management without addition of software. In other words, the power supply control IC 255 adjusts and monitors the above kinds of voltages by hardware control. For this reason, even if the head unit controller 21 becomes out of control, the power supply control IC 255 can perform fault control and stop the power supply in a case where, in spite of the control, any of the setting values of the above kinds of power supply voltages which are set inside the power supply control IC 255 is exceeded.

The FB resistor 256 adjusts the output voltage of the head power supply DC/DC converter 253. Specifically, the voltage outputted from the head power supply DC/DC converter 253 toward the head print unit 30 is adjusted by applying a predetermined voltage to the FB resistor 256 by a FB_CNT signal outputted from a DAC of the power supply control IC 255 and thereby controlling the current flowing into the FB resistor 256.

A VH_SNS resistance voltage-dividing circuit 257 divides the voltage (VH power supply) outputted from the head unit power supply 52. The head unit controller 21 reads the voltage (VH_SNS) divided by the VH_SNS resistance voltage-dividing circuit 257, and changes (adjusts) the head power supply to be fed to the head print unit 30 by way of the power supply control IC 255 based on the read voltage. Specifically, the power supply control IC 255 is controlled to adjust the voltage of the FB_CNT signal, thereby changing the head power supply.

The VH voltage is set to 32 V in the specifications, but the maximum output as a rated power supply may be set to 36 V. In this case, in the VH_SNS resistance voltage-dividing circuit 257, a constant (a resistance ratio) is set such that the output of the VH_SNS signal to the head unit controller 21 may not exceed 3.3 V. In this regard, the resistance ratio in the case of supplying a voltage of 36 V is 9.9:1. Then, in the case of supplying a voltage of 32 V as the VH voltage, the voltage of the VH_SNS is 2.9 V. In the case of supplying a voltage of 5.5 V as the VH voltage, the voltage of the VH_SNS is 0.5 V.

Subsequently, the head IF 26 is described. As illustrated in FIG. 3, the head IF 26 is provided between the head power supply generator 25 and the head print unit 30. The head IF 26 includes the head power supply current detector and a switch circuit 265. The head power supply current detector functions as an example of a status detector that detects the status of the printing head, and includes a low resistance 261, a current detector circuit 262, an amplifier 263, and an ADC 264 for A/D conversion of an output from the amplifier 263. Meanwhile, the switch circuit 265 switches a signal outputted from the print data generator 24 and a signal to be inputted to the print data generator 24 (in other words, a leak voltage from the logic section 32). Note that the head logic control signals 62 outputted from the switch circuit 265 include, for example, a DATA signal, a CLK signal, an LT signal, and the like, and cover all the signals for controlling the logic section 32.

Description is given herein of an operation of detecting a head current by the above described configurations. As illustrated in FIG. 3, when a current (head current) flows into the low resistance 261, a voltage difference occurs between the input and the output of the low resistance 261. For example, in a case where a current at 1 A flows into the low resistance 261 under the conditions where the resistance value of the low resistance 261 is 0.1Ω and the input voltage is 10 V, the voltage is decreased by 0.1 V to an output voltage of 9.9 V due to the occurrence of a voltage difference between the input and the output of the low resistance 261.

The current detector circuit 262 is a current sensor amplifier for monitoring the current from the voltage between the input and the output of the low resistance 261. Here, the current detector circuit 262 may be formed by using a known detector circuit, and the explanation of the detailed operation of the current detector circuit 262 is omitted herein. The amplifier 263 adjusts a gain such that the output of the current detector circuit 262 can be within an input range of the ADC 264. The ADC 264 performs A/D conversion of the output from the amplifier 263.

The head unit controller 21 monitors the current value of the head power supply by accessing the ADC 264 by way of an SIO IF. After the startup, the head unit controller 21 controls the print data generator 24 to switch Head control signal input/output ports to the input mode. Then, in order to detect a leak voltage from the logic section 32 of the head print unit 30, the switch circuit 265 is controlled such that an input/output port of the switch circuit 265 is switched to the input mode to enable the leak voltage from the logic section 32 to be inputted to the print data generator 24.

When confirming (detecting) that there is no voltage leakage, the print data generator 24 switches the IF_CNT signal and switches the input/output port of the switch circuit 265 to the output mode (in other words, sets the input/output port to enable a signal to be outputted to the logic section 32 of the head print unit 30). Moreover, the head unit controller 21 switches the Head control signal input/output ports of the print data generator 24 to the output mode. In this regard, an input circuit of the switch circuit 265 has a power down protection function, and an IF capable of receiving an input voltage up to +5.5 V is used for a logic power supply of +3.3 V.

Figures 4, 4A:
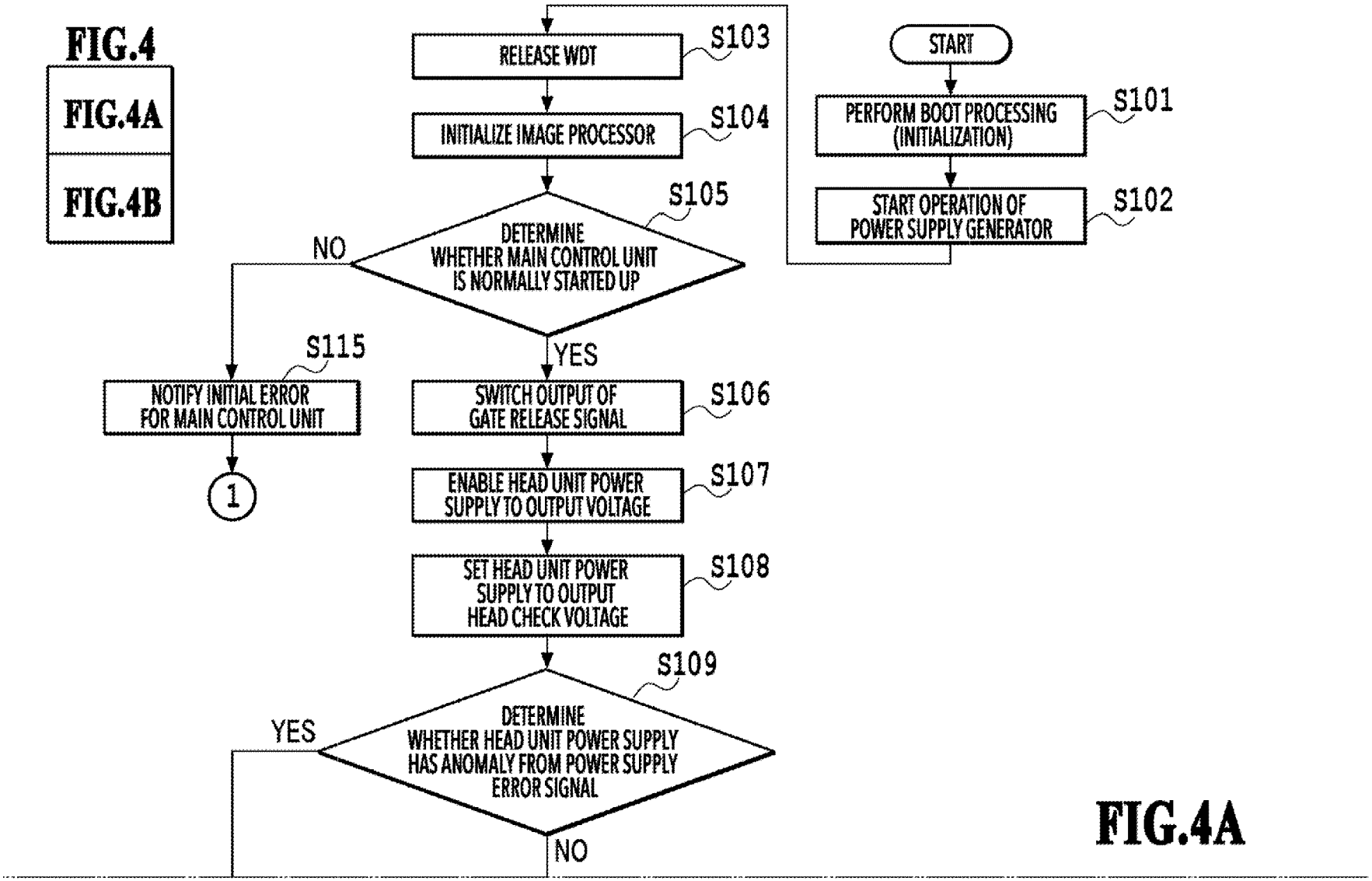
FIG. 4A is a flowchart presenting a processing procedure executed by a main control unit of the image forming apparatus.
Figure 4B:
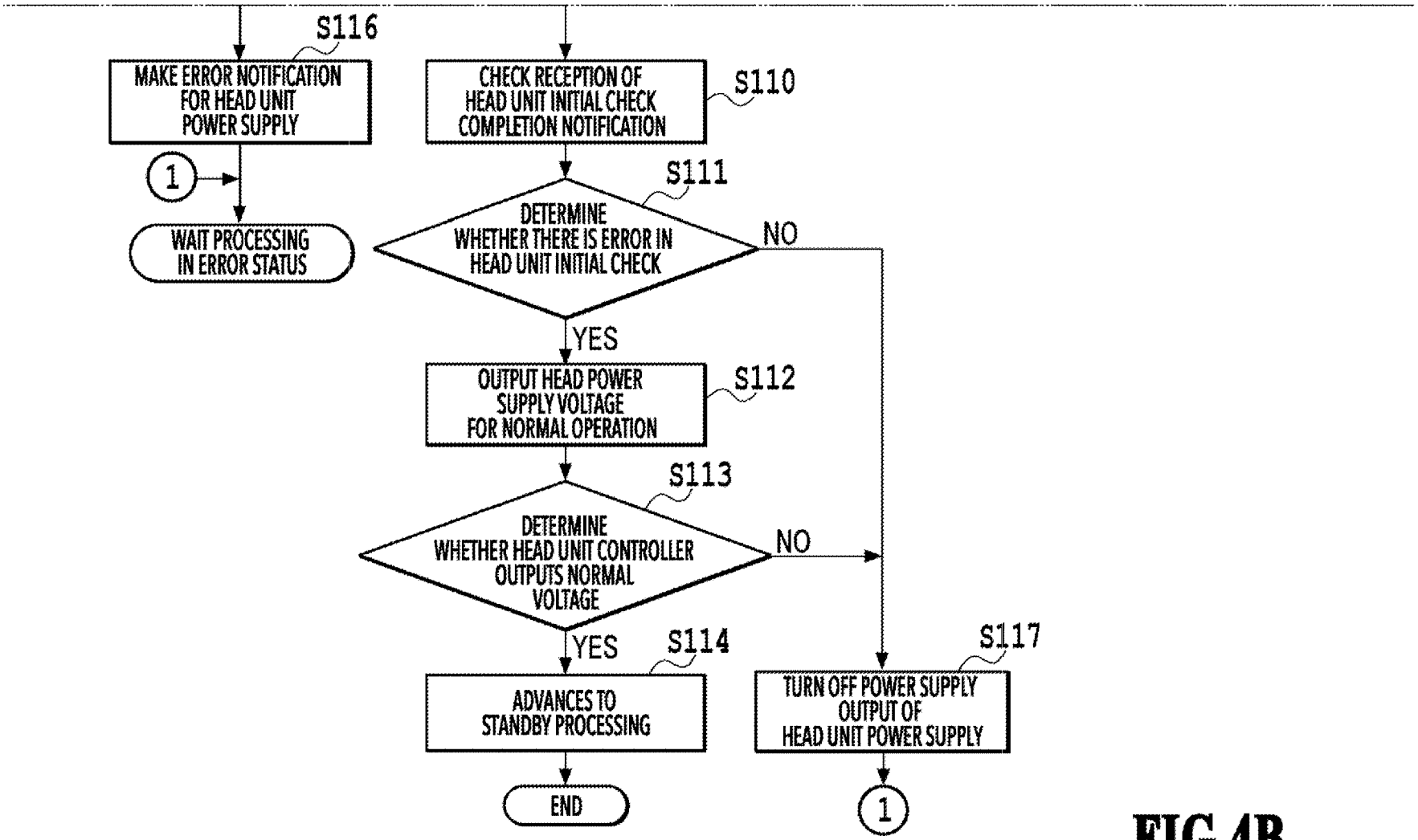
FIG. 4B is a flowchart presenting a processing procedure executed by a main control unit of the image forming apparatus.

Next, a processing procedure executed by the main control unit 10 of the image forming apparatus is described by using a flowchart in FIGS. 4A and 4B. In the explanation of the flowchart, sign "S" represents step. This also applies in explanation for the following flowchart.

At S101, the main controller 12 executes boot processing and develops parameters on the RAM1 13 based on the data in the ROM1 14. Along with this, the main controller 12 initializes the input/output of the internal port, a transfer rate and a transfer scheme of the SIO for accessing the DAC 110 of the external IF circuit 15, a LAN IF, and an internal timer circuit.

When detecting the completion of all the initialization of them, the main controller 12 enables the peripheral IF and controls the port to turn on a DC/DC converter in the power supply generator 11 at S102 in order to feed the power supplies to the peripheral blocks.

At S103, the main controller 12 enables the internal timer circuit and accesses the WDT 111 periodically at intervals of 5 ms to clear the timer of the WDT 111. At S104, the main controller 12 enables the block that executes image processing. The image processor 16 is composed of the ASIC, FPGA, or the like as described above. For example, when the image processor 16 is composed of an FPGA, the main controller 12 preforms data transfer processing for making internal data available. The image processor 16 outputs a signal indicating the completion of the initialization as the Status signal.

At S105, the main controller 12 determines whether the hardware of the main control unit 10 is normally started up by monitoring the output result (the startup check signal) of the WDT 111, the power supply generator 11, and the image processor 16 as described above. When the startup check signal is 'L' at S105, the main controller 12 advances the processing to S115. At S115, the main controller 12 notifies the host device 40 of an initialization error of the main control unit 10 or records error information to the RAM1 13 and the ROM1 14, and then advances the processing to wait processing in an error status. The ROM1 14 used herein is assumed to be a flash ROM and is capable of recording the error information. This also applies to the ROM described below.

When the startup check signal is 'H' at S105, the main controller 12 determines that the system is normally started up, and sets the head unit power supply 52 to an output-enabled status in order to start up the head control unit 20. In this case, the main controller 12 transmits data '0' to the DAC 110 via the SIO and sets the power supply voltage output to the head unit power supply 52 to 0 V (in other words, initializes the power supply voltage output).

At S106, the main controller 12 controls the port to switch the output of the GATE release signal from 'L' to 'H'. Thus, the GATE circuit 113 is enabled to output a power supply ON signal as a power supply ON-OUT signal to the head unit power supply 52.

Figure 5B:
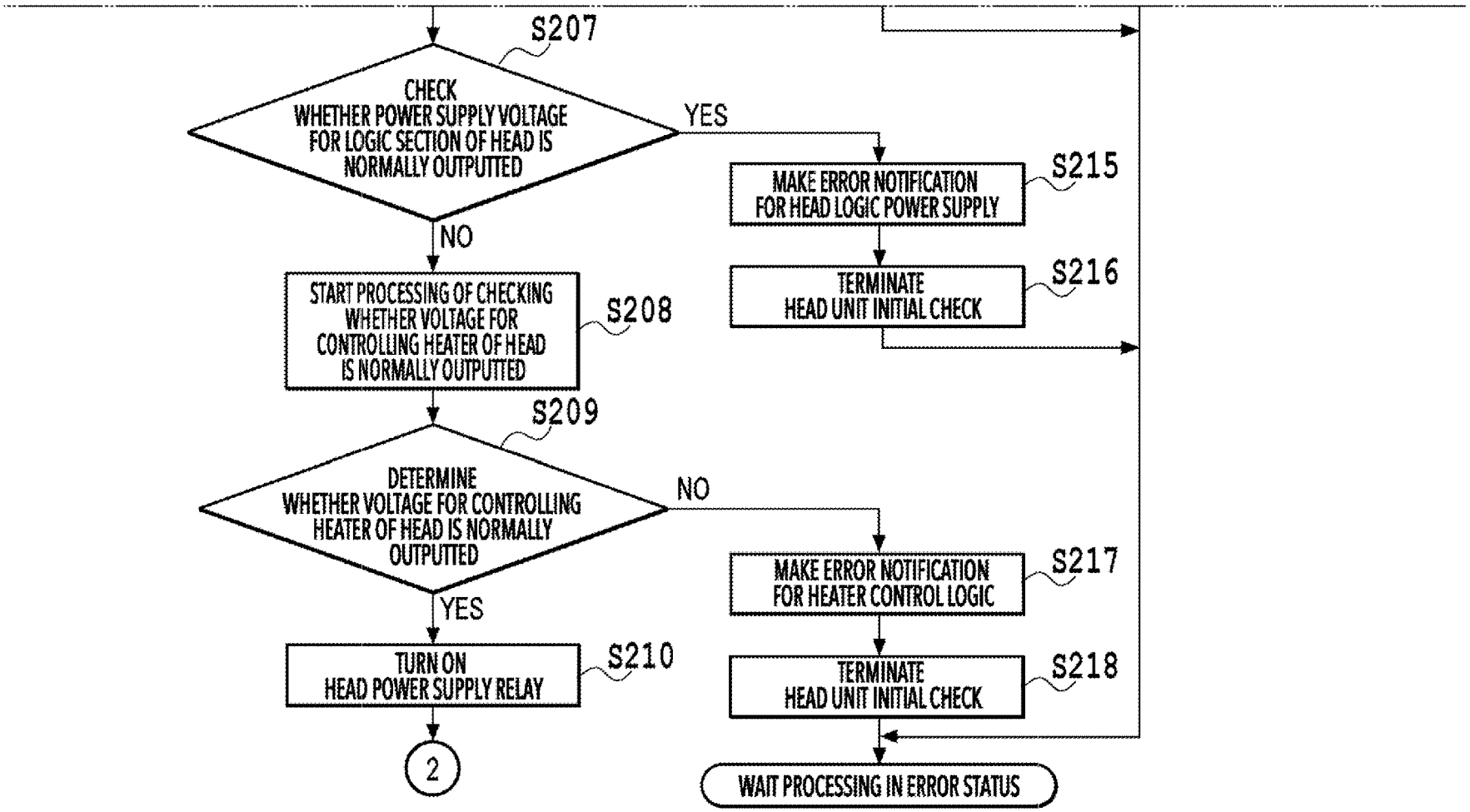
FIG. 5B is a flowchart presenting a processing procedure executed by a control unit of the image forming apparatus.

At S107, the main controller 12 controls the port such that the power supply ON signal may be outputted to the GATE circuit 113, and thereby sets the head unit power supply 52 to a voltage output (application) enabled status by way of the GATE circuit 113. At S108, the main controller 12 transmits predetermined data to the DAC 110, and thereby sets the head unit power supply 52 to output +5.5 V. In this step, 2C (hex) is written as the predetermined data to the DAC 110 and the DAC 110 linearly outputs 0.86 V. Here, when the processing at S108 is completed, processing at S201 in FIG. 5A described later is started.

At S109, the main controller 12 reads a power supply Error signal as an input signal. When the power supply Error signal is 'L', the main controller 12 determines that the head unit power supply 52 has an anomaly and advances the processing to S116. At S116, the main controller 12 notifies the host device 40 that the head unit power supply 52 has the anomaly, records the error information to the RAM1 13 and the ROM1 14, and advances to the wait processing in the error status.

When the main controller 12 does not detect an error (anomaly) in the head unit power supply 52 at S109, the main controller 12 advances the processing to S110. At S110, the main controller 12 checks whether a head unit initial check completion notification transmitted from the head unit controller 21 of the head control unit 20 via the communication IF1 17 is received. Note that the processing at S110 is executed in response to completion of processing at S404 in FIG. 7A.

At S111, the main controller 12 checks whether there is an error from initial check information concerning the head unit initial check completion notification. Specifically, the main controller 12 checks whether the head unit initial check completion notification is received from the head unit controller 21 within a predetermined period or whether an error is reported in the head unit initial check completion notification.

When the head unit initial check completion notification is not received within the predetermined period or the error is reported in the head unit initial check completion notification as a result of checking the initial check information at S111, the main controller 12 advances the processing to S117. At S117, the main controller 12 sets 'L' in the port of the power supply ON signal in order to turn off the power supply output of the head unit power supply 52, thereby suspends the power supply output of the head unit power supply 52, and then advances to the wait processing in the error status. In this regard, even when the error status is reported by the head unit controller 21, the power supply does not have to be turned off in some cases depending on the error. In such a case, the main controller 12 may perform control without turning off the power supply.

Meanwhile, when the notification that the initialization of the head control unit 20 is completed and the head control unit 20 and the head print unit 30 are normally started up is received from the head unit controller 21 at S111, the main controller 12 advances the processing to S112. At S112, the main controller 12 executes output processing of the head power supply voltage for normal operation. In this processing, the main controller 12 controls the SIO of the main controller 12 to output E0 (hex) to the DAC 110 in order to cause the head unit power supply 52 to output 28 V. Thus, the DAC 110 outputs 4.375 V, and the head unit power supply 52 outputs 28 V to the head control unit 20.

At S113, the main controller 12 checks (determines) whether a notification that the normal voltage of 28 V is outputted is received from the head unit controller 21. Then, when determining that the notification is received, the main controller 12 advances to stand-by processing at S114, and waits for transmission of print data from the host device 40. In this processing, the processing of feeding the normal head power supply may be started after the print data is received.

Next, a processing procedure executed by the head control unit 20 of the image forming apparatus is described by using a flowchart in FIGS. 5A, 5B, 6, 7A and 7B. At S201, the head unit controller 21 executes boot processing and develops parameters on the RAM2 22 based on the data in the ROM2 23. Along with this, the head unit controller 21 initializes the input/output of an internal port and an ADC internally provided to monitor a voltage of an inputted VH power supply (VH_SNS). In addition, the head unit controller 21 initializes a transfer rate and a transfer scheme of an I2C bus for accessing the print data generator 24 and the power supply control IC 255 of the head power supply generator 25, and initializes an internal LAN IF and a communication IF2 27.

After completion of the boot processing, the head unit controller 21 reads the voltage of the ADC and checks the voltage of the inputted VH power supply (more exactly, VH_SNS) at S202. At S203, the head unit controller 21 determines whether the head unit power supply 52 normally supplies the voltage for initial check. Specifically, the head unit controller 21 determines whether the read value of the ADC is within a range of 5.5 V±5%. When the read voltage of the ADC is not within the range of 5.5 V±5%, the head unit controller 21 determines that the voltage outputted from the head unit power supply 52 is not the voltage for initial check, and advances the processing to S211.

Since the outputted voltage is determined not to be the voltage for initial check at S210, the head unit controller 21 notifies the host device 40 of the determination result and records the error information to the RAM2 22 and ROM2 23 at S211. At S212, the head unit controller 21 terminates the head unit initial check, and advances to the wait processing in the error status.

On the other hand, when the read voltage of the ADC is within the range of 5.5 V±5%, the head unit controller 21 determines that the voltage outputted from the head unit power supply 52 is the voltage for initial check of +5.5 V at S203. At S204, the head unit controller 21 checks a status of the power supply control IC 255 (I2C_IF0 signal) to check whether the power supply control IC 255 normally operates.

At S205, the head unit controller 21 determines whether the power supply control IC 255 is in a normally operating status. When detecting at S205 an anomaly as the status of the power supply control IC 255, the head unit controller 21 advances the processing to S213. Since the power supply control IC 255 is determined not to be in the normally operating status at S204, the head unit controller 21 notifies the host device 40 of the determination result and records the error information to the RAM2 22 and ROM2 23 at S213. At S214, the head unit controller 21 terminates the head unit initial check, and advances to the wait processing in the error status. The host device 40 causes the display unit 41 to display, as indicating the detection of the power control IC error, the error of the board on which the power supply control IC 255 is mounted in the head control unit 20, and prompts replacement of the board on which the head power supply generator 25 is mounted.

Meanwhile, when the head unit controller 21 confirms at S205 that the power supply control IC 255 normally operates and an operation of monitoring the voltages and the like normally runs, the head unit controller 21 advances the processing to S206. At S206, the head unit controller 21 starts a head check sequence and causes the heater control logic DC/DC converter 252 to output a voltage of +3.3 V_HB by controlling an internal register of the power supply control IC 255. After that, the head unit controller 21 similarly causes the heater control logic DC/DC converter 252 to output a voltage of VHT by controlling the internal register of the power supply control IC 255. Moreover, the head unit controller 21 controls an IF_CNT signal by accessing the print data generator 24 via the I2C bus, and thereby performs control to switch the switch circuit 265 to a mode for outputting signals to the print data generator 24.

At S207, the head unit controller 21 monitors the power supply control IC 255 and checks whether the power supply voltage of +3.3 V_HB is normally outputted (applied). When determining (detecting) at S207 that the power supply voltage of +3.3 V_HB is not normally outputted, the head unit controller 21 advances the processing to S215.

Since it is detected at S207 that the head logic power supply is not normally outputted, the head unit controller 21 executes head logic power supply error notification processing at S215. Specifically, the head unit controller 21 notifies the host device 40 of the head logic power supply error, and records the error information to the RAM2 22 and the ROM2 23. At S216, the head unit controller 21 terminates the head unit initial check, and advances to the wait processing in the error status. The host device 40 causes the display unit 41 to display, as indicating the detection of the +3.3 V_HB error, the error of the board on which the heater control logic DC/DC converter 252 is mounted in the head control unit 20, and prompts replacement of the board on which the head power supply generator 25 is mounted.

Meanwhile, when detecting that the power supply at +3.3 V_HB (power supply to be fed to the logic section 32) is normally outputted at S207, the head unit controller 21 advances the processing to S208. At S208, the head unit controller 21 monitors the power supply control IC 255 and checks whether the outputted VHT (power supply for controlling the heater 31) is normally outputted.

When detecting at S209 that the VHT is not normally outputted, the head unit controller 21 advances the processing to S217. Since it is detected that the heater control logic power supply is not normally outputted, the head unit controller 21 executes heater control logic error notification processing at S217. Specifically, the head unit controller 21 notifies the host device 40 of the error and records the error information to the RAM2 22 and the ROM2 23. At S218, the head unit controller 21 terminates the head unit initial check, and advances to the wait processing in the error status. The host device 40 causes the display unit 41 to display, as indicating the detection of the VHT power supply error, the error of the board on which the heater control logic DC/DC converter 252 is mounted in the head control unit 20, and prompts replacement of the board on which the head power supply generator 25 is mounted.

Meanwhile, when detecting at S209 that the VHT is normally outputted, the head unit controller 21 advances the processing to S210 in order to check whether the head power supply DC/DC converter 253 can normally operate. At S210, the head unit controller 21 controls the port of the head unit controller 21 to turn on the head power supply relay 254, and starts check processing for supplying the head power supply DC/DC converter 253 with +5.5 V.

Figure 6:
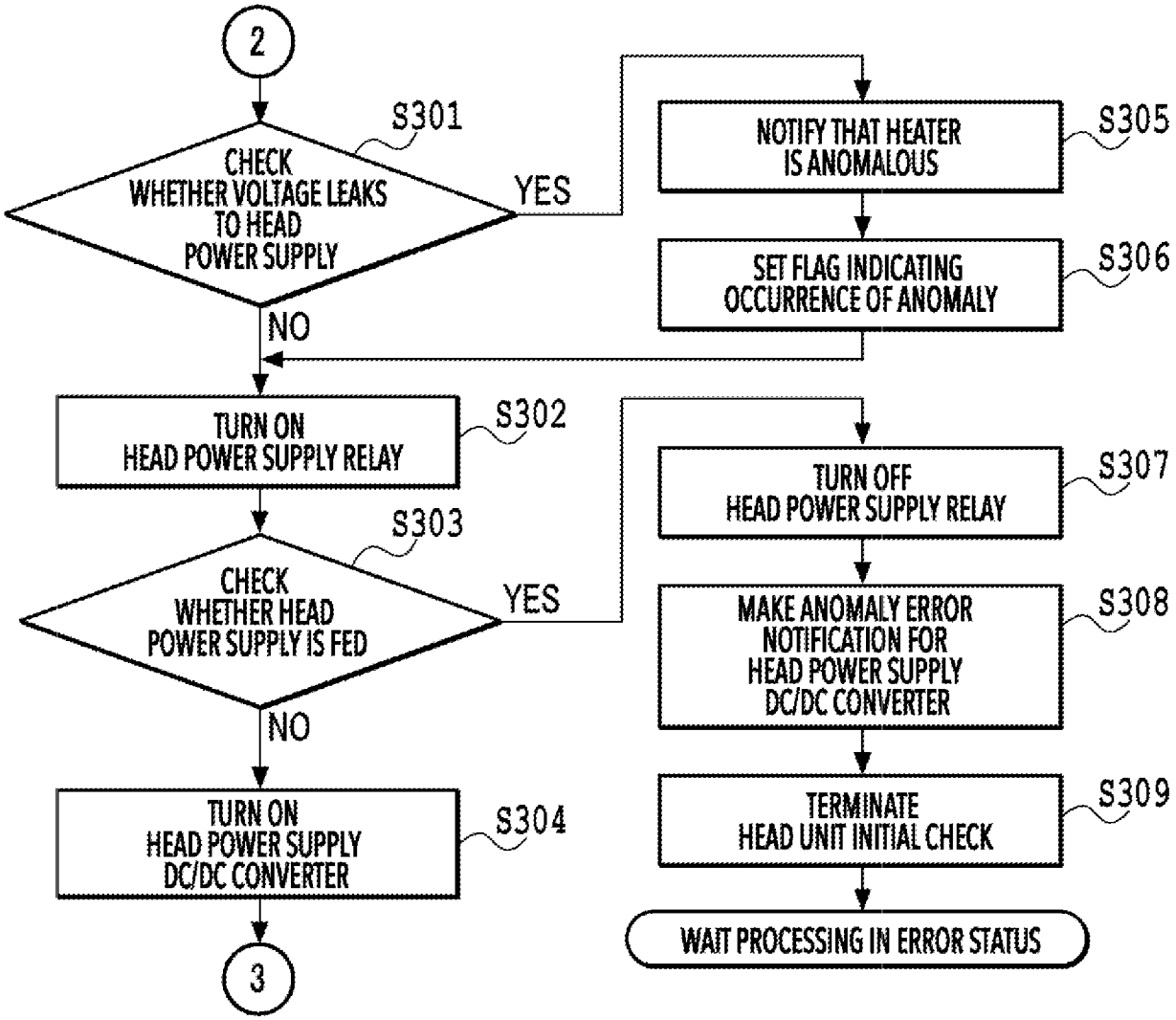
FIG. 6 is the flowchart presenting the processing procedure executed by the control unit of the image forming apparatus.

Proceeding to FIG. 6, before the head power supply relay 254 is controlled to turn on (before the VH power supply starts to be fed to the head power supply DC/DC converter 253), the head unit controller 21 checks an SNS signal terminal of the power supply control IC 255 and determines whether a voltage leaks to the head power supply at S301. Here, the SNS signal terminal is a signal terminal for +3.3 V_HL, the head power supply, VHT, and +3.3 V_HB, which are to be inputted to the power supply control IC 255. When there is a voltage leakage of several V, which is not supposed to be outputted to the head power supply, the head unit controller 21 determines that the voltage leakage occurs in the head print unit 30 at S301 and advances the processing to S305.

At S305, the head unit controller 21 notifies that the heater 31 is anomalous. Further, at S306, the head unit controller 21 sets, in the RAM2 22, a flag that indicates that an anomaly occurs in the heater 31. Also when the anomaly of the heater 31 is detected, the head unit controller 21 subsequently controls the head power supply DC/DC converter 253 in order to detect details of the error and thereby confirms the details of the error. To this end, the processing is advanced to S302.

Meanwhile, when no voltage leaks to the head power supply (no voltage is detected) at S301, the processing is also advanced to S302. In sum, when the head logic power supply (+3.3 V_HB) and the heater control logic power supply (VHT) are normally outputted, the processing is advanced to S302.

At S302, the head unit controller 21 controls the port to turn on the head power supply relay 254 and supplies the head power supply DC/DC converter 253 with +5.5 V in order to check whether the head power supply DC/DC converter 253 can normally operate.

At S303, the head unit controller 21 monitors the head power supply outputted from the head power supply DC/DC converter 253 via the power supply control IC 255, and checks whether the head power supply is fed only by turning on the head power supply relay 254. When detecting at S303 that the head power supply is fed with only the head power supply relay 254 turned on, the head unit controller 21 determines that the head power supply DC/DC converter 253 is short-circuited, and turns off the head power supply relay 254 at S307.

At S308, the head unit controller 21 executes anomaly error notification processing for the head power supply DC/DC converter 253. Specifically, the head unit controller 21 notifies the host device 40 of the anomaly error for the head power supply DC/DC converter 253, and records the error information to the RAM2 22 and the ROM2 23. At S309, the head unit controller 21 terminates the head unit initial check, and advances to the wait processing in the error status.

The host device 40 causes the display unit 41 to display, as indicating the detection of the head power supply error, the error of the board on which the head power supply DC/DC converter 253 is mounted in the head control unit 20, and prompts replacement of the board on which the head power supply generator 25 is mounted. In addition, along with this, when previously notified of an anomaly of the heater 31, the host device 40 makes a notification of the anomaly of the head print unit 30 to prompt head replacement.

Meanwhile, when detecting at S303 that the head power supply is not fed under the condition where only the head power supply relay 254 is turned on, the head unit controller 21 controls the register of the power supply control IC 255 to cause the head power supply DC/DC converter 253 to output a predetermined voltage at S304. In this operation, the power supply control IC 255 outputs the FB_CNT signal by controlling the internal DAC while monitoring the output of the head power supply, thereby changes the current of the FB resistor 256 configured to adjust the output voltage of the head power supply DC/DC converter 253, and thus adjusts the output voltage to +5 V.

When +5 V is outputted as the head power supply, the head unit controller 21 controls the internal I2C IF to read the voltage of the ADC 264 of the head IF 26. When the head power supply is not fed to the heater 31 of the head print unit 30 (in other words, when no current flows into the low resistance 261), the voltage value of the ADC 264 is substantially 0 V. Meanwhile, when the head power supply is fed to the heater 31 of the head print unit 30 (in other words, when a current flows into the low resistance 261), the voltage of the ADC 264 is a predetermined voltage or above.

Proceeding to FIG. 7A, when determining at S401 that the voltage of the ADC 264 is substantially 0 V and the head power supply is not fed to the heater 31 of the head print unit 30, the head unit controller 21 advances the processing to S402. At S402, the head unit controller 21 checks statuses of signals inputted as the Head control signals to the print data generator 24, and thereby detects whether a voltage leaks to the logic section 32. At S402, the head unit controller 21 determines that no voltage leaks from the heater 31 to the logic section 32 when all the Head control signals inputted to the print data generator 24 are substantially 0 V.

At S403, the head unit controller 21 recognizes completion of the initial check with the VH power supply set to +5.5 V, controls the register of the power supply control IC 255 to thereby switch the VH_ON signal to be inputted to the head power supply DC/DC converter 253 to 'L', and thus turns off the head power supply output. At S404, the head unit controller 21 issues a head unit initial check completion notification to the main controller 12 via the communication IF2 27. When the processing at S404 is completed, the processing at S110 in FIG. 4B is executed as above described.

At S405, the head unit controller 21 monitors the value of VH_SNS and thereby checks whether the main controller 12 of the main control unit 10 has changed (controlled) the output of the head unit power supply 52 from +5.5 V to +32 V. When the head unit controller 21 confirms (determines) at S406 that the output of the head unit power supply 52 has been changed to +32 V, the head unit controller 21 advances the processing to S407.

At S407, the head unit controller 21 controls the DAC of the power supply control IC 255 to adjust the voltage output of the FB_CNT, thereby setting the voltage to be outputted from the head power supply DC/DC converter 253 to +24 V. At S408, the head unit controller 21 waits for a print command from the main controller 12.

Meanwhile, when determining at S401 that the voltage of the ADC 264 is the predetermined voltage or above and the head power supply is fed to the heater 31 of the head print unit 30, the head unit controller 21 advances the processing to S409. Here, the predetermined voltage is a voltage not reachable even if a subtle voltage such as noise is added to 0 V.

Figure 7B:
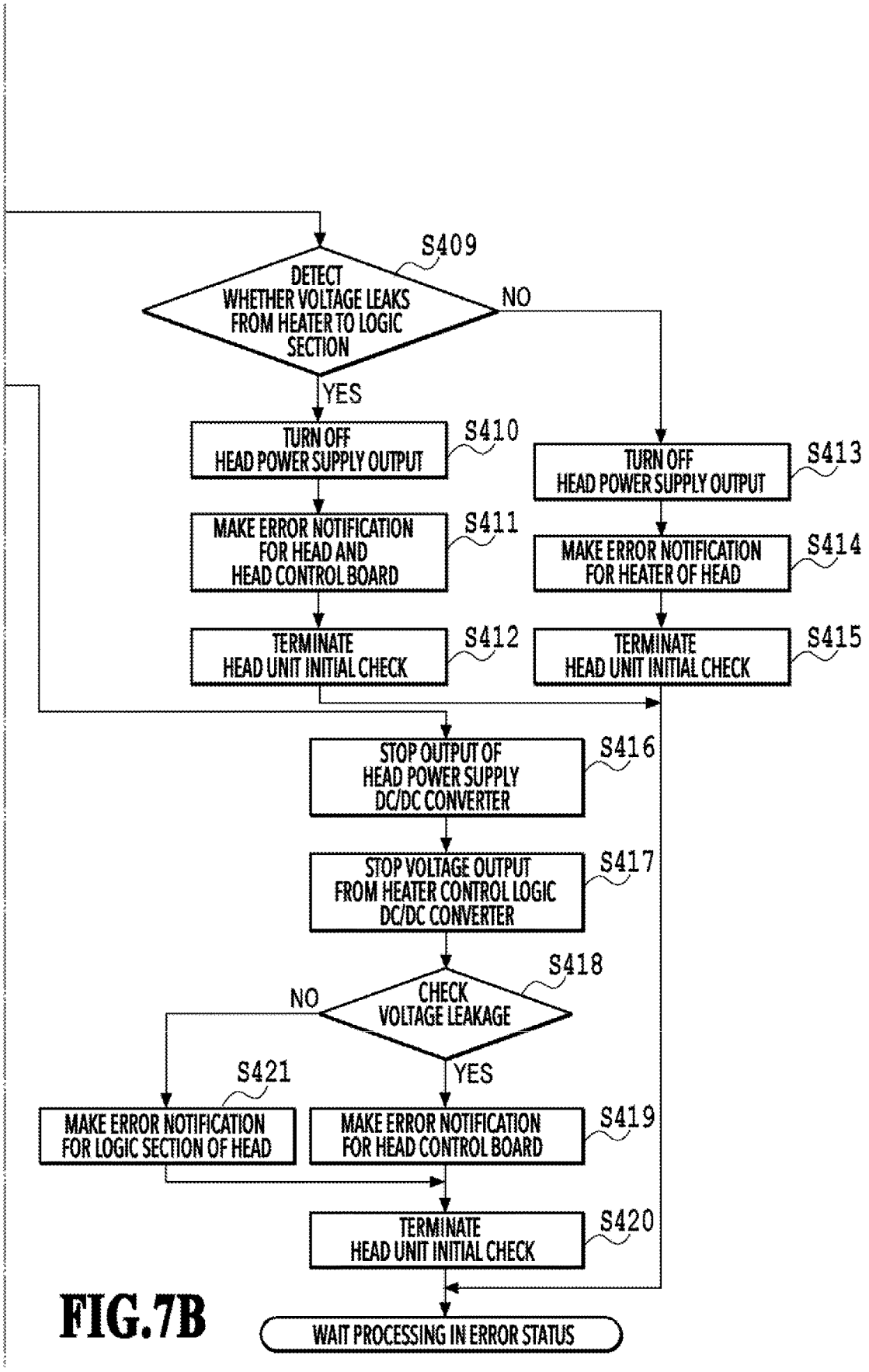
FIG. 7B is the flowchart presenting the processing procedure executed by the control unit of the image forming apparatus.

Proceeding to FIG. 7B, at S409, the head unit controller 21 detects the input statuses of the Head control signals inputted to the print data generator 24 and thereby detects whether a voltage leaks from the heater 31 to the logic section 32. When determining that the voltage leaks from the heater 31 to the logic section 32 as a result of the detection, the head unit controller 21 advances the processing to S410. Specifically, the head unit controller 21 reads the input statuses of the Head control signals inputted to the print data generator 24, determines that the voltage leaks (in other words, there is a failure) when any one of the ports is 'H', and advances the processing to S410.

At S410, for safety, the head unit controller 21 controls the register of the power supply control IC 255 to set the VH_ON signal to be inputted to the head power supply DC/DC converter 253 to 'L', thereby turning off the head power supply output. Moreover, since it is determined that the voltage leaks from the heater 31 to the logic section 32, the head unit controller 21 determines at S411 that the heater 31 and the board logic section have an anomaly. Then, the head unit controller 21 executes head and head control board error notification processing. Specifically, the head unit controller 21 notifies the host device 40 of a head and head control board error, prompts replacement of the head print unit 30 and the board (head control unit 20), and records the error information to the RAM2 22 and the ROM2 23. At S412, the head unit controller 21 terminates the head unit initial check, and advances to the wait processing in the error status.

When determining at S409 that no voltage leaks from the heater 31 to the logic section 32 as a result of the detection, the head unit controller 21 advances the processing to S413. Specifically, the head unit controller 21 reads the values of the Head control signals inputted to the print data generator 24, determines that no voltage leaks from the heater 31 to the logic section 32 when all the read values are substantially 0 V, and advances the processing to S413.

At S413, the head unit controller 21 determines that only the head has a failure, and for safety, controls the register of the power supply control IC 255 to set the VH_ON signal to be inputted to the head power supply DC/DC converter 253 to 'L', thereby turning off the head power supply output for safety. Then, at S414, the head unit controller 21 determines that an anomaly occurs in the heater 31 of the head print unit 30, and executes head heater error notification processing. Specifically, the head unit controller 21 notifies the host device 40 of the head heater error, causes the display unit 41 to display a prompt to replace the head print unit 30, and records the error information to the RAM2 22 and the ROM2 23. At S415, the head unit controller 21 terminates the head unit initial check, and advances to the wait processing in the error status.

Meanwhile, at S402, the head unit controller 21 determines that a voltage leaks from the heater 31 to the logic section 32 when any of the Head control signals inputted to the print data generator 24 is 'H'. At S416, the head unit controller 21 controls the power supply control IC 255 to stop the output of the head power supply DC/DC converter 253. At S417, by controlling the power supply control IC 255, the head unit controller 21 individually stops each of VHT and +3.3 V_HB from being outputted from the heater control logic DC/DC converter 252 to check whether there is a leakage from each of the power supply outputs. The head unit controller 21 checks the levels of the Head control signals at S418 and advances the processing to S419 when confirming a voltage leakage under the condition where each of the outputs of the heater control logic DC/DC converter 252 is off.

At S419, the head unit controller 21 determines that the board (head control unit 20) itself is broken. Then, the head unit controller 21 notifies the host device 40 and the main controller 12 via the communication IF2 27 that the board anomaly occurs, causes the display unit 41 to display a prompt to replace the board on which the switch circuit 265 is mounted, and records the error information to the RAM2 22 and the ROM2 23. At S420, the head unit controller 21 terminates the head unit initial check, and advances to the wait processing in the error status. At the time of the above notification, if the head unit controller 21 detects the flag that indicates the heater anomaly in the RAM2 22, the head unit controller 21 also makes a notification of information concerning a warning indicating that the head print unit 30 possibly has the anomaly. It is also easily conceivable to repeat the check processing again in response to this information concerning the warning.

Meanwhile, the head unit controller 21 checks the levels of the Head control signals at S418 and advances the processing to S421 when confirming no voltage leakage under the condition where each of the outputs of the heater control logic DC/DC converter 252 is off. At S421, the head unit controller 21 determines that the logic section 32 of the head print unit 30 is broken. Then, the head unit controller 21 notifies the host device 40 and the main controller 12 via the communication IF2 27 of the occurrence of the head anomaly and information on the concerned power supply block (VHT or +3.3 V_HB), and causes the display unit 41 to display a prompt to replace the head print unit 30. In addition, along with this, the head unit controller 21 records the error information to the RAM2 22 and the ROM2 23. At S420, the head unit controller 21 terminates the head unit initial check, and advances to the wait processing in the error status.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™, a flash memory device, a memory card, and the like.

According to the present invention, it is possible to safely start up the entire circuits in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-146237, filed Aug. 8, 2019 which is hereby incorporated by reference wherein in its entirety.

What is claimed is:

1. An image forming apparatus including a print head, comprising:

a first control unit configured to control the image forming apparatus;

a second control unit configured to control the print head; and a first voltage generator circuit configured to generate a voltage to be supplied to the second control unit under control of the first control unit, wherein the first control unit includes:

a startup check unit configured to check whether the first control unit is normally started up, and a setting unit configured to set the first voltage generator circuit to apply a voltage for head check when determining that the first control unit is normally started up by the startup check unit, and the second control unit includes:

an operation checker configured to check whether the second control unit normally operates in a case where the voltage for head check is applied to the second control unit, wherein, the operation checker:

performs a first check processing for determining whether a component included in the second control unit is in a normally operating status and a second check processing for checking whether the component performs a normal operation, enables, when the component is determined not to be in the normally operating status at the first check processing, a display unit to display a first error information regarding the component, and enables, when the component is determined not to perform the normal operation at the second check, the display unit to display a second error information regarding the component, the first control unit further includes a receiver configured to receive a notification from the second control unit indicating the second control unit normally operates, where, when determining that the second control unit normally operates by the notification, the setting unit sets the first voltage generator circuit to apply a voltage for normal operation which is higher than the voltage for head check, and the second control unit further includes an interface configured to supply power to the print head.

2. The image forming apparatus according to claim 1, wherein the first control unit controls the first voltage generator circuit such that the voltage to be supplied to the second control unit is gradually changed.

3. The image forming apparatus according to claim 1, wherein in a case where the second control unit detects that the voltage supplied from the first voltage generator circuit is changed, the second control unit controls the second voltage generator circuit such that the voltage to be supplied to the print head is changed.

4. The image forming apparatus according to claim 1, wherein the print head includes:

a plurality of heaters, and a logic circuit configured to operate the plurality of heaters, a second voltage generator circuit included in the second control unit configured to supply, as the voltage to be supplied to the print head, a logic voltage to the logic circuit and a heater voltage to each of the heaters, and a status detector configured to detect a status of the print head based on the voltage supplied to the print head.

5. The image forming apparatus according to claim 4, wherein the status detector detects the status of the print head by at least detecting a current supplied to the print head from the second voltage generator circuit based on the heater voltage.

6. The image forming apparatus according to claim 5, wherein the second voltage generator circuit further generates a voltage for operating the second control unit, and after the second control unit detects a failure in the logic circuit under conditions where the voltage to be supplied to the print head and the voltage for operating the second control unit are being supplied, the second control unit determines that a board on which the second control unit is mounted has a failure in a case where the status detector detects an anomaly in the second control unit under a condition where the voltage for operating the second control unit is being supplied.

7. The image forming apparatus according to claim 6, further comprising a display unit configured to display a status of the image forming apparatus, wherein, in a case where the first control unit receives a notification on a failure from the second control unit, the first control unit causes the display unit to display a name and a location of a portion where the failure is occurring.

8. The image forming apparatus according to claim 5, wherein the second voltage generator circuit further generates a voltage for operating the second control unit, and after the second control unit detects a failure in the logic circuit under conditions where the voltage to be supplied to the print head and the voltage for operating the second control unit are being supplied, the second control unit determines that the print head has a failure in a case where the status detector detects an anomaly in the logic circuit under a condition where the voltage for operating the second control unit is being supplied.

9. The image forming apparatus according to claim 5, wherein the second voltage generator circuit further generates a voltage for operating the second control unit, and in a case where the second control unit detects a voltage leakage from the heater to the logic circuit under conditions where the voltage to be supplied to the print head and the voltage for operating the second control unit are being supplied, the second control unit determines that the print head and a board on which the second control unit are mounted have a failure.

10. The image forming apparatus according to claim 5, wherein the second voltage generator circuit further generates a voltage for operating the second control unit, and in a case where the second control unit detects a current flowing into the print head and detects no voltage leaking from the heater to the logic circuit under conditions where the voltage to be supplied to the print head and the voltage for operating the second control unit are being supplied, the second control unit determines that the print head has a failure.

11. The image forming apparatus according to claim 1, wherein the normal operation performed by the component is a voltage applying operation for a logic section of the print head, and the logic section generates a timing signal for ejecting ink.

12. The image forming apparatus according to claim 11, wherein a logic circuit included in the second control unit switches an input/output port to an input state such that a leak voltage from the logic section of the print head is input, and the voltage applying operation is performed when the logic circuit operates in the input state.

13. A method of controlling an image forming apparatus, the image forming apparatus including a first control unit configured to control the image forming apparatus, a print head, a second control unit configured to control the print head, and a first voltage generator circuit configured to generate a voltage to be supplied to the second control unit under control of the first control unit, the method comprising:

checking, by the first control unit, whether the first control unit is normally started up;

setting, by the first control unit, the first voltage generator circuit to apply a voltage for head check when determining that the first control unit is normally started up by the startup check unit;

checking, by the second control unit, whether the second control unit normally operates in a case where the voltage for head check is applied to the second control unit;

performing, by the second control unit, a first check processing for determining whether a component included in the second control unit is in a normally operating status and a second check processing for determining whether the component performs a normal operation, to:

enable, when the component is determined not to be in the normally operating status at the first check processing, a display unit to display a first error information regarding the component, and enable, when the component is determined not to perform the normal operation at the second check processing, the display unit to display a second error information regarding the component;

receiving, by the first control unit, a notification from the second control unit indicating the second control unit normally operates, to set, when determining that the second control unit normally operates by the notification, the first voltage generator circuit to apply a voltage for normal operation which is higher than the voltage for head check; and supplying, by the second control unit, power to the print head.

14. The method according to claim 13, wherein the first control unit controls the first voltage generator circuit such that the voltage to be supplied to the second control unit is gradually changed.

15. The method according to claim 13, wherein in a case where the second control unit detects that the voltage supplied from the first voltage generator circuit is changed, the second control unit controls a second voltage generator circuit included in the second control unit such that the voltage to be supplied to the print head is changed.

16. The method according to claim 13, wherein the print head includes a plurality of heaters, and a logic circuit configured to operate the plurality of heaters, and a second voltage generator circuit included in the second control unit configured to supply, as the voltage to be supplied to the print head, a logic voltage to the logic circuit and a heater voltage to each of the heaters, the method further comprising detecting a status of the print head based on the voltage supplied to the print head.

17. The method according to claim 16, wherein the status of the print head is detected by detecting a current supplied to the print head from the second voltage generator circuit based on the heater voltage.

18. The method according to claim 13, wherein the second voltage generator circuit further generates a voltage for operating the second control unit, and after the second control unit detects a failure in the logic circuit under conditions where the voltage to be supplied to the print head and the voltage for operating the second control unit are being supplied, the second control unit determines that a board on which the second control unit is mounted has a failure in a case where the status detector detects an anomaly in the second control unit under a condition where the voltage for operating the second control unit is being supplied.

19. The method according to claim 13, wherein the second voltage generator circuit further generates a voltage for operating the second control unit, and after the second control unit detects a failure in the logic circuit under conditions where the voltage to be supplied to the print head and the voltage for operating the second control unit are being supplied, the second control unit determines that the print head has a failure in a case where the status detector detects an anomaly in the logic circuit under a condition where the voltage for operating the second control unit is being supplied.

20. A non-transitory computer readable storage medium storing a program for causing a computer to perform a method of controlling an image forming apparatus, the image forming apparatus including, a first control unit configured to control the image forming apparatus, a print head, a second control unit configured to control the print head, and a first voltage generator circuit configured to generate a voltage to be supplied to the second control unit under control of the first control unit, the method comprising:

checking, by the first control unit, whether the first control unit is normally started up;

setting, by the first control unit, the first voltage generator circuit to apply a voltage for head check when determining that the first control unit is normally started up by the startup check unit;

checking, by the second control unit, whether the second control unit normally operates in a case where the voltage for head check is applied to the second control unit;

performing, by the second control unit, a first check processing for determining whether a component included in the second control unit is in a normally operating status and a second check processing for determining whether the component performs a normal operation, to:

enable, when the component is determined not to be in the normally operating status at the first check processing, a display unit to display a first error information regarding the component, and enable, when the component is determined not to perform the normal operation at the second check processing, the display unit to display a second error information regarding the component;

receiving, by the first control unit, a notification from the second control unit indicating the second control unit normally operates, to set, when determining that the second control unit normally operates by the notification, the first voltage generator circuit to apply a voltage for normal operation which is higher than the voltage for head check; and supplying, by the second control unit, power to the print head.

* * * * *